US009059529B1

(12) United States Patent
Lai

(10) Patent No.: US 9,059,529 B1
(45) Date of Patent: Jun. 16, 2015

(54) POWER OUTLET WITH A SUPPORT PLATFORM WITH INCLINED SURFACES WITH THROUGH HOLES AND A SHUTTER WITH AN INCLINE WITH A HOLE

(71) Applicant: Li-Chun Lai, New Taipei (TW)

(72) Inventor: Li-Chun Lai, New Taipei (TW)

( * ) Notice: Subject to any disclaimer, the term of this patent is extended or adjusted under 35 U.S.C. 154(b) by 0 days.

(21) Appl. No.: 14/190,570

(22) Filed: Feb. 26, 2014

(51) Int. Cl.
*H01R 13/44* (2006.01)
*H01R 13/453* (2006.01)
*H01R 13/64* (2006.01)

(52) U.S. Cl.
CPC ..... *H01R 13/4534* (2013.01); *H01R 13/64* (2013.01); *H01R 13/44* (2013.01)

(58) Field of Classification Search
USPC ..... 439/135–141
See application file for complete search history.

(56) References Cited

U.S. PATENT DOCUMENTS 4,379,607 A * 4/1983 Bowden, Jr. ..... 439/137
4,722,693 A * 2/1988 Rose ..... 439/137
5,702,259 A * 12/1997 Lee ..... 439/137
6,086,391 A * 7/2000 Chiu ..... 439/145
6,422,880 B1 * 7/2002 Chiu ..... 439/137
6,893,275 B2 * 5/2005 Ng et al. ..... 439/137
7,452,221 B1 * 11/2008 Oddsen et al. ..... 439/137
7,455,538 B2 * 11/2008 Germain ..... 439/137
7,645,148 B2 * 1/2010 Carbone et al. ..... 439/137
7,645,149 B2 * 1/2010 Carbone et al. ..... 439/137
7,820,909 B2 * 10/2010 Castaldo et al. ..... 174/53
7,868,719 B2 * 1/2011 Bazayev et al. ..... 335/18
8,550,829 B2 * 10/2013 Huang ..... 439/145

* cited by examiner

*Primary Examiner* — Chandrika Prasad
(74) *Attorney, Agent, or Firm* — Ming Chow; Sinorica, LLC

(57) ABSTRACT

A power outlet having a base, a top cover, a safety shutter, and an elastic member is disclosed. The base may include a support platform having a first electrode and a second electrode. The top cover may include a first receptacle and a second receptacle and overlaying the base. When in a first position, the safety shutter may be placed at a fulcrum of the support platform with equilibrium and mask the first electrode and the second electrode. The safety shutter may include a first incline and a second incline. When a foreign object invades either the first receptacle or the second receptacle, the safety shutter may lose its equilibrium despite still masking the first electrode and the second electrode. Only after the corresponding plug pins have been inserted into the receptacles before the safety shutter may be pushed away from the first position.

5 Claims, 10 Drawing Sheets

POWER OUTLET WITH A SUPPORT PLATFORM WITH INCLINED SURFACES WITH THROUGH HOLES AND A SHUTTER WITH AN INCLINE WITH A HOLE

BACKGROUND

1. Technical Field

The present disclosure relates to a power outlet, in particular, to a power outlet capable of preventing invasion of foreign objects when the power outlet is not properly used.

2. Description of Related Art

With electronic devices becoming inseparable part of our daily life, it is fully anticipated that additional power outlets would be needed in order to have the increased number of the electronic devices properly powered. Kids may therefore subject to heightened risk as they may employ objects other than the power plugs to touch receptacles of the power outlets out of their curiosity, increasing the likelihood of electric shock.

In order to reduce the occurrence of the electric shock, one conventional power outlet utilizes a retractable cover or the equivalent to mask electrodes coupled to a power source until the receptacle of the power outlet is properly opened allowing for the power plugs to pass through.

Despite such conventional approach could prevent the power plug from being inserted into the receptacles without any mechanical restriction, both electrodes (one is connected to the fire wire and the other is grounded) in the receptacle may still be conducted at the same time if anyone manages to open the retractable cover, failing to serve the purpose of protecting the innocent from the electric shock.

Therefore, in order to remedy the deficiency in the above-mentioned conventional art, the present disclosure provides a power outlet with better protection for the children facing the potential electric shock in the household.

SUMMARY OF THE DISCLOSURE

One primary objective of the present disclosure is to prevent foreign objects from invading a power outlet when the latter is not properly used.

The disclosed power outlet may include a base, a top cover, a safety shutter, and an elastic member. The base may include a support platform having a first electrode, a second electrode, and a fulcrum between the first electrode and the second electrode. The safety shutter may slide on the support platform. The top cover may include a first through hole that corresponds to the first electrode and a second through hole that corresponds to the second electrode, position-wise. The top cover may overlay the base so that the safety shutter may be disposed between the top cover and the base. One end of the elastic member may be in contact with the safety shutter, which may be maintained at a first position due to the spring force/elasticity of the elastic member. When in the first position, the safety shutter may be placed on the support platform with equilibrium and mask both the first electrode and the second electrode. The safety shutter may include a first incline and a second incline. When a foreign object invades into either a first receptacle or a second receptacle, the safety shutter may lose its balance/equilibrium wobbling around the fulcrum despite still masking the first electrode and the second electrode. Only after the corresponding plug pins have been inserted into the receptacles before the safety shutter may be pushed away from its first position by the first incline and the second incline, enabling the engagement between the plug pins and the electrodes.

When in the first position, either the first incline or the second incline may be positioned to be in contact with at least one of the plug pin. As such, even the foreign object invades into one of the receptacles (the first receptacle or the second receptacle) the safety shutter may remain masking both the first electrode and the second electrode, despite losing its balance/equilibrium and wobbling around the fulcrum.

The support platform may also have a left incline and a right incline located at both sides of the fulcrum. The fulcrum may be set at the highest position of a connection adjoining the left incline and the right incline.

The center of the first incline may be formed with a cavity corresponding to the position of one of the plug pins. Because of the plug pin being arc-shaped at its front end, at the time the plug pin is in contact with the first incline and the cavity three contact points may exist for strengthening the push of the safety shutter by the first incline.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DESCRIPTION OF THE EXEMPLARY EMBODIMENTS

The aforementioned and other technical contents, features, and efficacies will be shown in the following detail descriptions of a preferred embodiment corresponding with the reference Figures.

Figure 1:
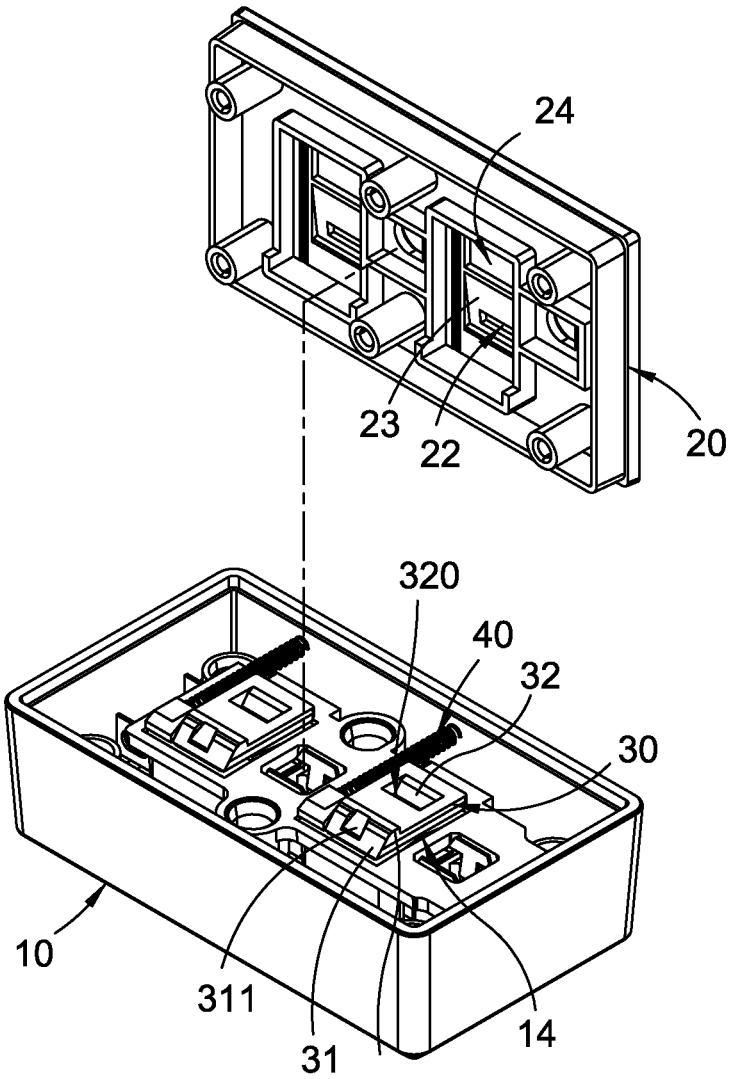
FIG. 1 shows a structural schematic diagram of a power outlet according to one embodiment of the present disclosure.
Figure 2:
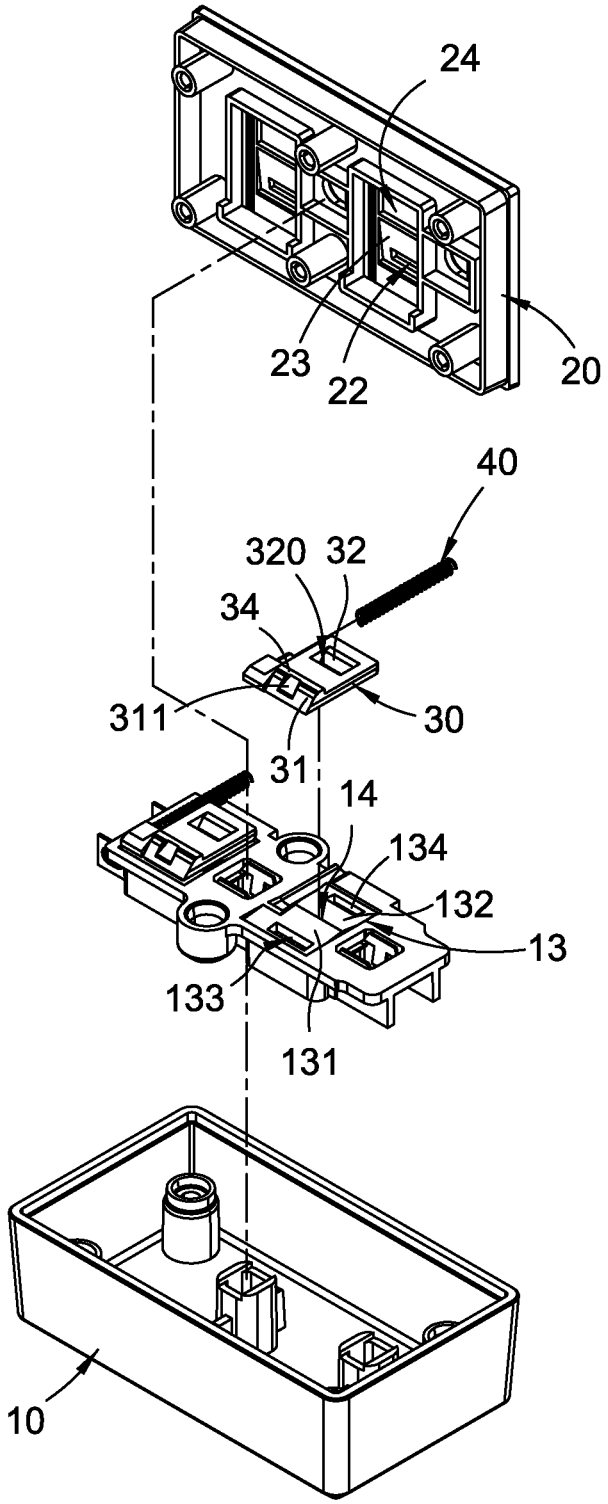
FIG. 2 shows a structural schematic diagram of a power outlet according to one embodiment of the present disclosure.

Please refer to FIGS. 1 and 2 showing structural schematic diagrams of a power outlet according to one embodiment of the present disclosure. The power outlet may include a base 10, a top cover 20, a safety shutter 30 and an elastic member 40.

The base 10 may further include a first electrode 11, a second electrode 12, a support platform 13 and a fulcrum 14. In one implementation, the base 10 is a box-shaped structure within which the first electrode 11 and the second electrode 12 are placed and secured (shown in FIG. 3). Using a power outlet with two AC power receptacles for example, either the first electrode 11 or the second electrode 12 may be connected to a fire wire while the other may be grounded. In another implementation, a power outlet with three AC power receptacles where another electrode (or the third electrode) may be used could be applicable. The support platform 13 may be a surface above the first electrode 11 and the second the upper electrode 12 and have a left incline 131 along with a right incline 132. The left incline 131 may have a first through hole 133 in communication with the first electrode 11, while the right incline 132 may have a second through hole 134 in communication with the second electrode 12. The fulcrum 14 may be positioned between the first electrode 11 and the second electrode 12, when the left incline 131 and the right incline 132 may be located on both sides of the fulcrum 14. It is worth noting that the fulcrum 14 may be located at the highest point of a connection adjoining the left incline 131 and the right incline 132.

Figure 4:
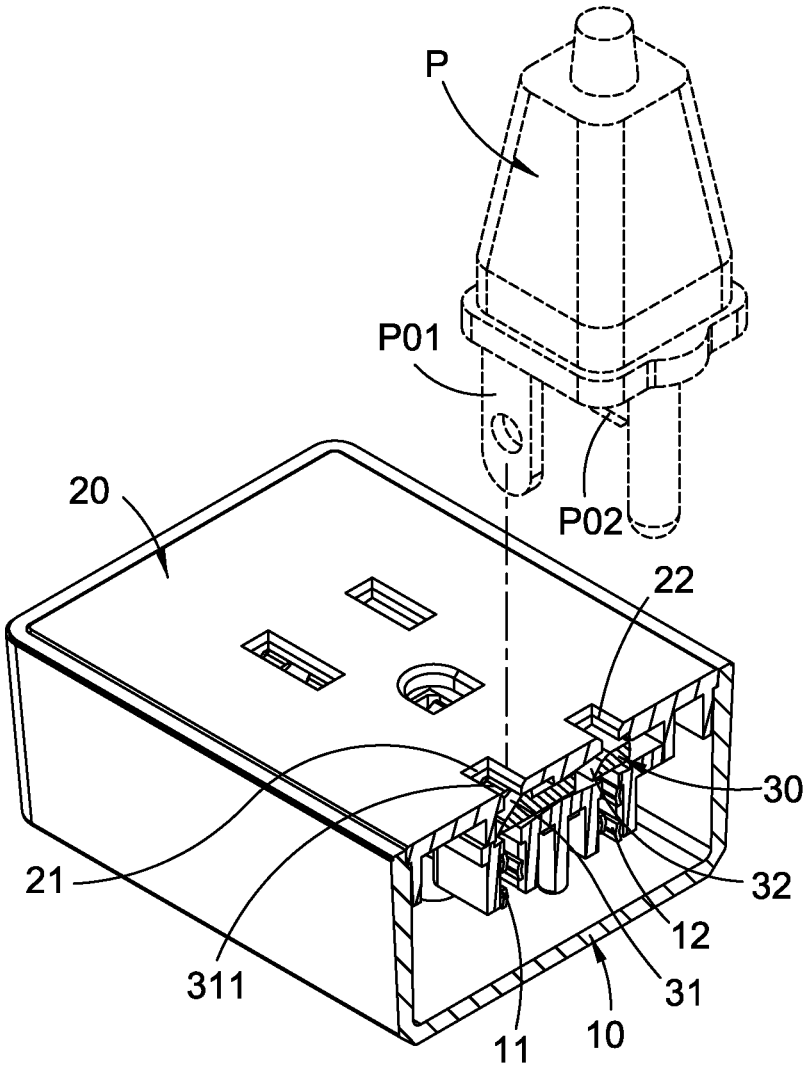
FIG. 4 shows a schematic diagram of a power outlet in use according to one embodiment of the present disclosure.

The top cover 20 may overlay the base 10 while including a first receptacle 21 and a second receptacle 22. In the two-receptacle embodiment, the first electrode 11 may correspond to the first receptacle 21 and the second electrode 12 may correspond to the second receptacle 22, position-wise. Illustrated in FIGS. 4 and 8, when the power plug P is properly inserted into the power outlet, the first plug pin P01 may be in contact with the first electrode 11 through the first receptacle 21, and the second plug pin P02 may be in contact with the second electrode 12 through the second receptacle 22.

Figure 3:
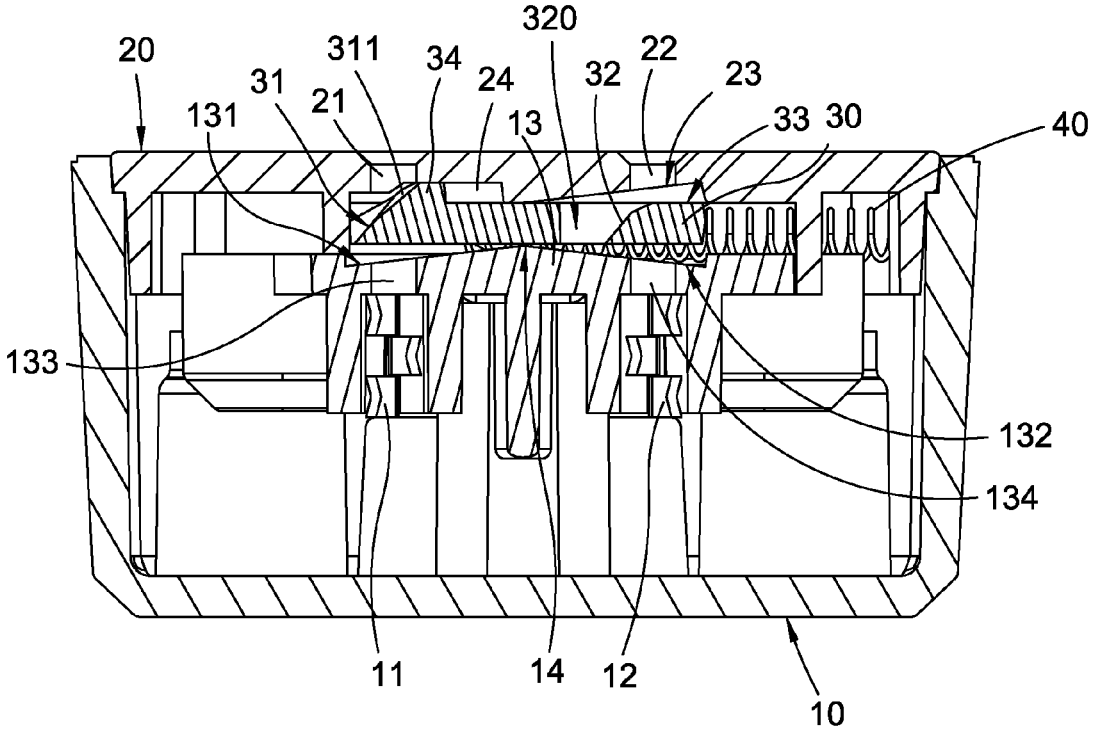
FIG. 3 shows a cross-sectional view of a power outlet according to one embodiment of the present disclosure.

The safety shutter 30 may be implemented in terms of a sheet of electrically insulating element. The safety shutter 30 may be placed between the base 10 and the top cover 20. The safety shutter 30 may slide on the supporting platform 13 and swing with respect to the fulcrum 14. The elastic member 40 may be a spring, with one end thereof held in contact with the safety shutter 30, and the other end of the same held in contact with either the top cover 20 or the base 10. The spring force or the elasticity of the elastic element 40 may maintain the safety shutter 30 at a first position where the safety shutter 30 may be positioned at the fulcrum 14 of the support platform 13 with equilibrium and therefore mask the first electrode 11 and the second electrode 12 (as shown in FIG. 3). Meanwhile, the safety shutter 30 may have a first incline 31 and a second incline 32, with a first side of the second incline 32 equipped with a first punch-through hole 320 allowing for the second plug pin P02 to pass through.

Figure 5:
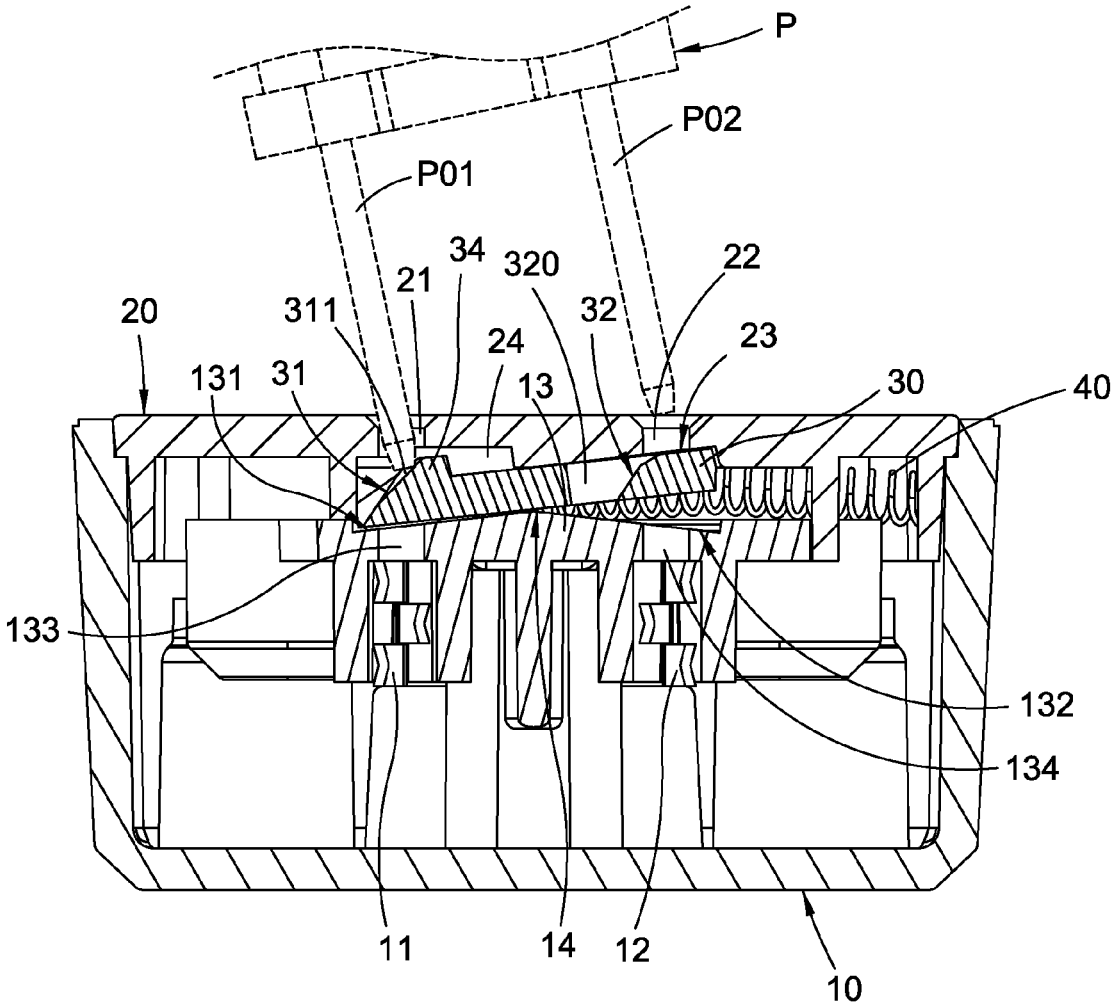
FIG. 5 is another schematic diagram of a power outlet in use according to one embodiment of the present disclosure.
Figure 6:
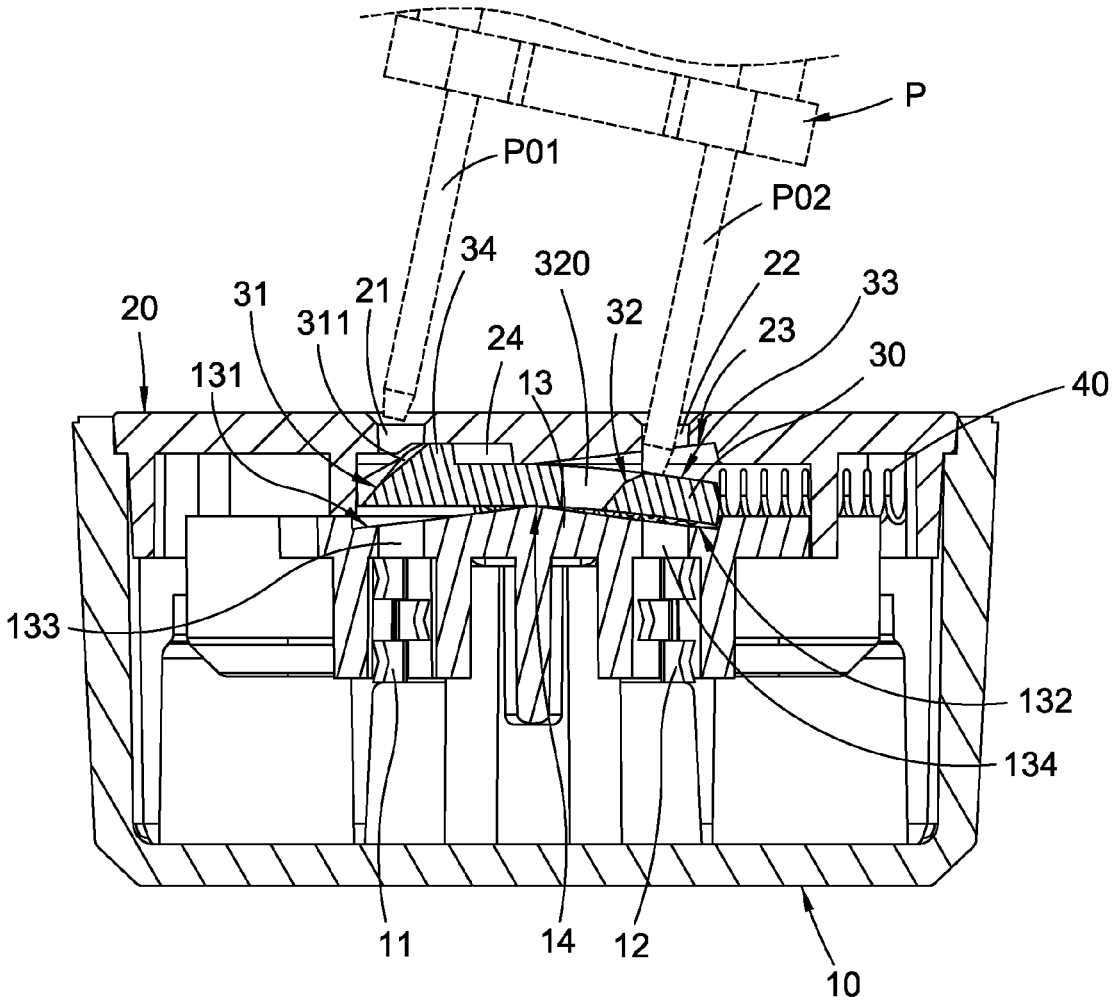
FIG. 6 is another schematic diagram of a power outlet in use according to one embodiment of the present disclosure.
Figure 7:
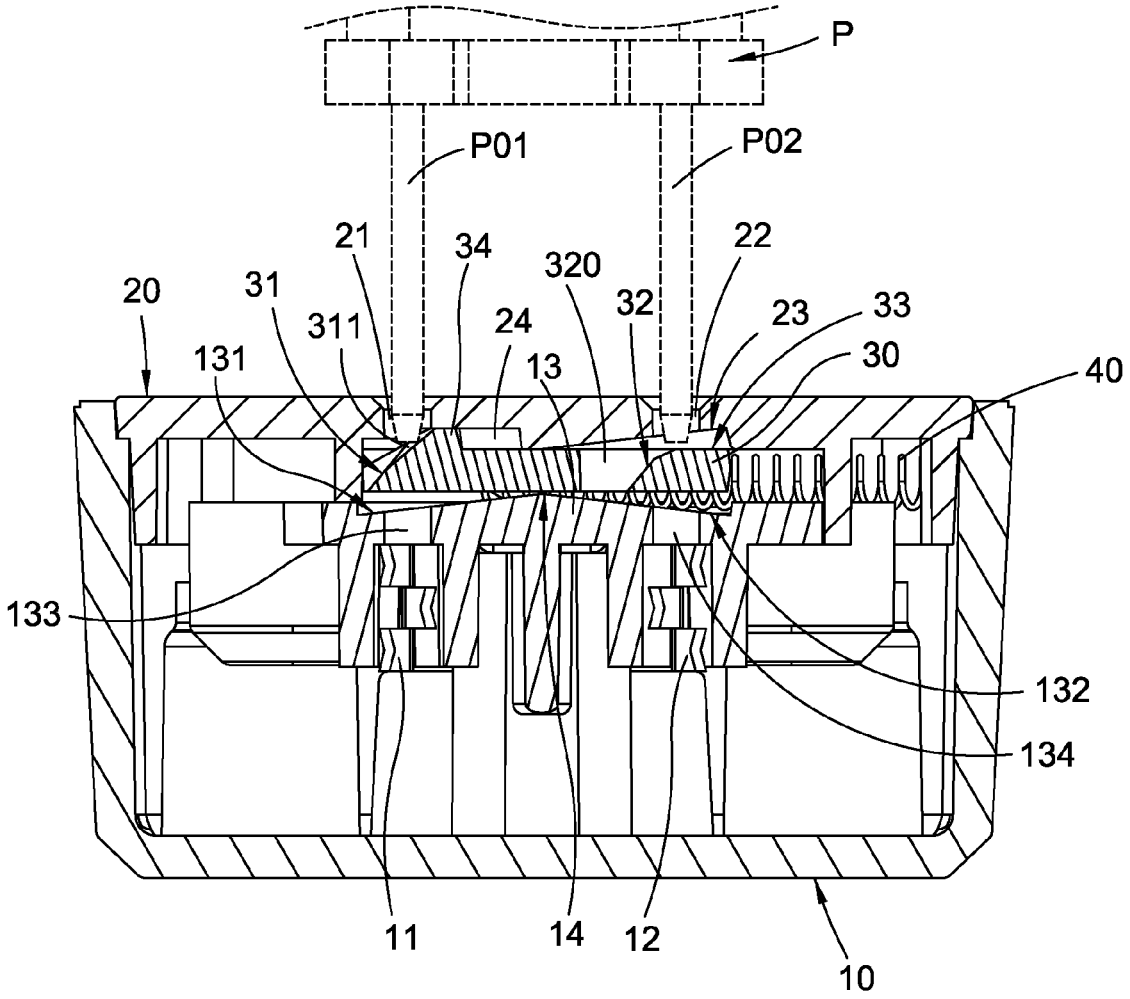
FIG. 7 is a schematic diagram showing a plug pin properly inserted into a receptacle of a power outlet according to one embodiment of the present disclosure.
Figure 8:
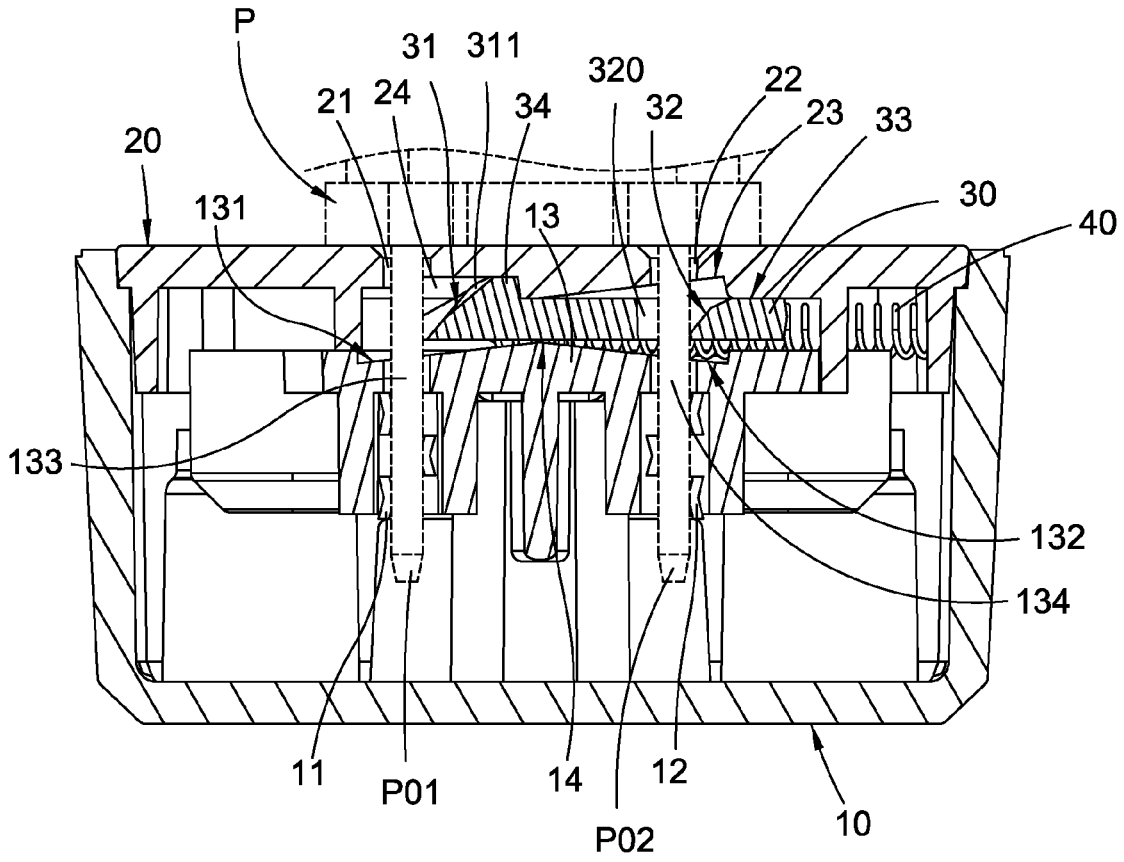
FIG. 8 is a schematic diagram showing a plug pin properly in contact with an electrode of a power outlet according to one embodiment of the present disclosure.

A second side of the first incline 31 and the second incline 32 may be in the proximity of the top cover 20. So long as any foreign object invades either the first receptacle 21 or the second receptacle 22, or only one of the plug pins (P01 or P02) is inserted through its respective receptacle (the first receptacle 21 or the second receptacle 22), the safety shutter 30 may be tiled by either the first plug pin P01 or the second plug pin P02, resulting in the safety shutter 30 wobble around the fulcrum 14 without equilibrium (illustrated in FIGS. 5 and 6). Even so, the safety shutter 30 may be still at the first position thereof, continuing masking the first electrode 11 and the second electrode 12. According to one embodiment of the present disclosure, the safety shutter 30 may be pushed out of the first position despite with the equilibrium. As illustrated in FIGS. 7 and 8, when the plug pins P01 and P02 of the power plug P are simultaneously inserted into the first receptacle 21 and second receptacle 22, respectively, the first plug pin P01 may be in contact with the first incline 31 and the second plug pin P02 may be contacting an outer side surface 33 of the safety shutter 30 at which point the safety shutter 30 may still be with the equilibrium. When the first plug pin P01 continues applying the pressure to the first incline 31, safety shutter 30 may be pushed away from the first position and the second incline 32 may move toward the second plug pin P02, at which point the first plug pin P01 and the second plug pin P02 may exert the pressure on the first incline 31 and the second incline 32, respectively, thereby pushing the security shutter 30 to a second position. When the security shutter 30 is at the second position, the plug pins P01 and P02 may pass through the first punch-through hole 320 to be in contact or engaged with the first electrode 11 and the second electrode 12.

According to one embodiment of the present disclosure, the first incline 31 and the second incline 32 may not be with the same height from the level at which the safety shutter 30 slides. In its first position, either the first incline 31 or the second incline 32 may be in contact with at least one of the plug pins P01 and P02 of the power plug P. As shown in FIG. 3, the first incline 31 may correspond to the first receptacle 21 and when the power plug P is properly inserted into the power outlet the plug pins P01 and P02 may be in contact with the safety shutter at both sides of the fulcrum 14. With the pushing of the plug pins P01 and P02, the equilibrium of the security shutter 30 may be maintained while one of the plug pins P01 and P02 may be in contact with the first incline 31 first. Thereafter, as the power plug P continues to be pushed into the power outlet the plug pin (for example, P01) may cause the first incline 31 to push the safety shutter 30 away from its first position. And the second incline 31 may be moved to be in contact with the other plug (in other words, P02) pin. The plug pins P01 and P02 may push the first incline 31 and the second incline 32, which may facilitate the removal of the safety shutter 30 from its first position.

In the embodiment of the present disclosure, the top cover 20 may be formed with a third incline 23 corresponding to the right incline 132 and a groove 24 corresponding to the left incline 131. The third incline 23 and the right incline 131 may tilt symmetrically with respect to the direction the security shutter 30 slides. Specifically, from the cross-sectional view of the power outlet of the present disclosure the right incline 132 and the third incline 23 together defines a fan-shaped space, as shown in FIG. 3. Thus, the third incline 23 and the right incline 132 may be closer to each other at one side of the fulcrum 14 as both become more distant on the other side of the fulcrum 14. When a single foreign object invades or one of the plug pin P01 or P02 is inserted into the first receptacle 21 (see FIGS. 5 and 6), the plug pin P01 or P02 may push the safety shutter 30 toward the left incline 131, causing the safety shutter 30 to lose its balance/equilibrium and mask the first electrode 11 preventing the other plug pin from contacting the first electrode 11. At the same time, the other side of the safety shutter 30 may rise with respect to the fulcrum 14 and fit into the third incline 23. The third incline 23 may therefore restrain the tilt of the safety shutter 30, which may be caused by the push originating from the first plug pin P01 onto the first incline 31. The safety shutter 30 may be formed with a protruding block 34 in the proximity of the first incline 31 and such protruding block 34 may slide within the groove 24. When the safety shutter 30 is pushed away from its first position, the groove 24 may be used to restrain the further movement of the protruding block 34, ensuring the safety shutter 30 to be remaining in the second position.

In one embodiment of the present disclosure, a cavity 311 may be formed at the center of the first incline 31 corresponding to the location of the plug pin P01. Since the end of plug pins P01 and P02 may be arc-shaped (see the first plug pin P02 shown in FIG. 4), when the plug pin P01 or P02 touches the first incline 31 and the cavity 311 three contact points in total may strengthen the pushing of the safety shutter 30 by the first incline 31.

Figure 9A:
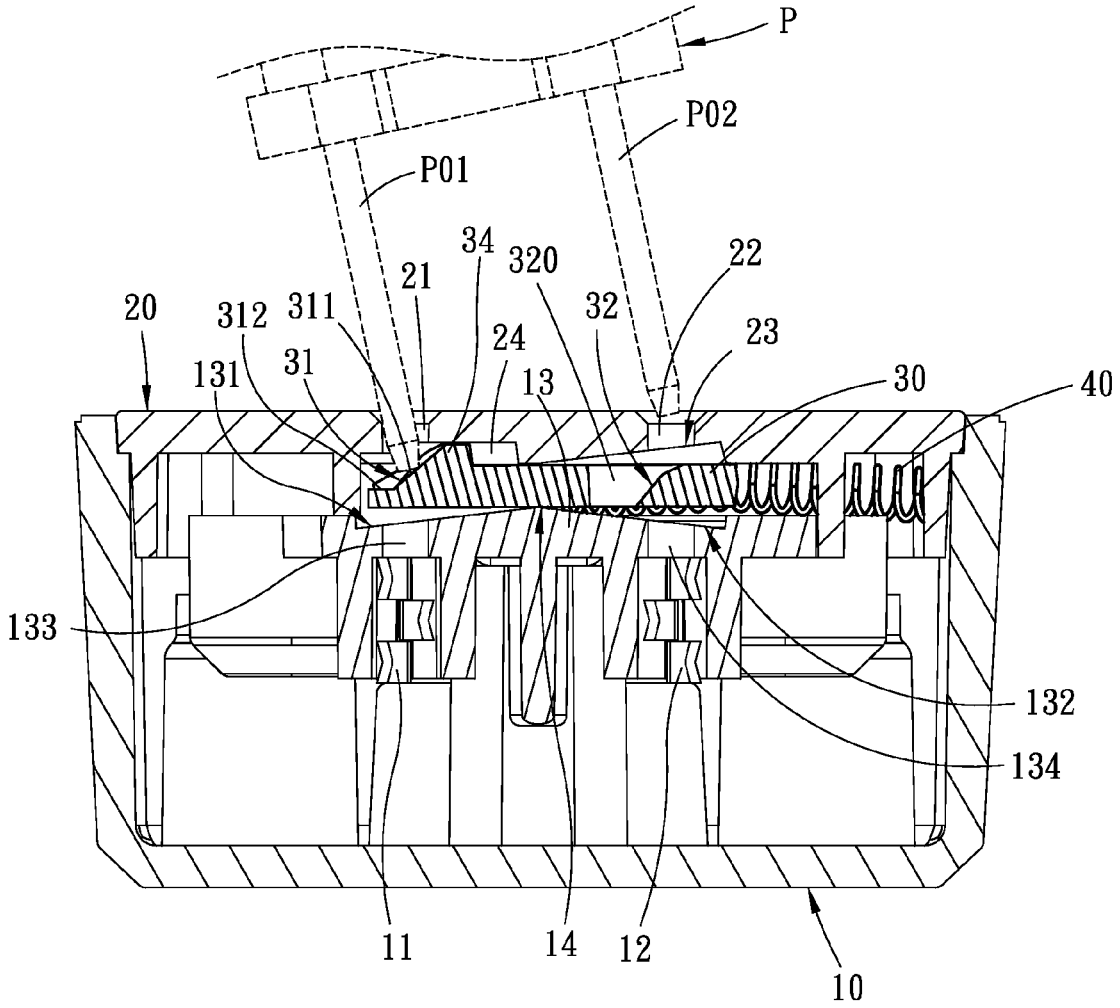
FIG. 9A is another schematic diagram of a power outlet in use according to one embodiment of the present disclosure.
Figure 9B:
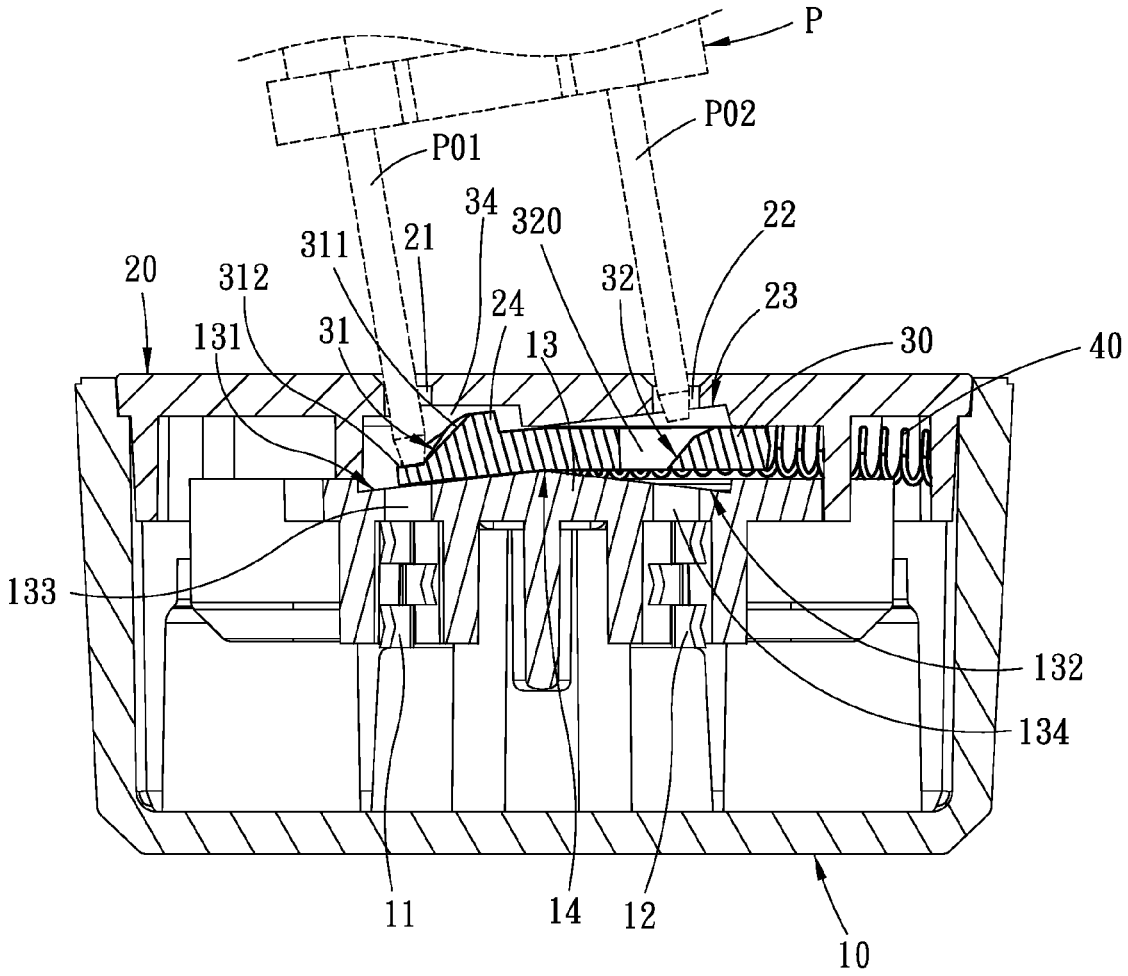
FIG. 9B shows the power outlet in FIG. 9A according to one embodiment of the present disclosure.

Please refer to the embodiment shown in both FIGS. 9A and 9B. One difference between the embodiment illustrated in FIGS. 9A and 9B and the previous embodiments is a blocking plate 312 may extend from a front end of the first incline 31 of the safety shutter 30. When only one plug pin (for example, the plug pin P01) is inserted into its respective receptacle (for example, the first receptacle 21), the other end of the safety shutter 30 may rise with respect to the fulcrum 14 without fitting into the third incline 23, which may cause the safety shutter 30 to move backwardly and expose the first through hole 133. At the same time, the blocking plate 312 may function to block the first plug pin P01 and prevent the same from contacting the first electrode 11 through the first through hole 133.

Some modifications of these examples, as well as other possibilities will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims.

What is claimed is:

1. A power outlet, which is pluggable and engaged by a power plug having at least two plug pins, comprising:

a base including a support platform having a first electrode, a second electrode, and a fulcrum between the first electrode and the second electrode are placed, the support platform being a surface above the first electrode and the second electrode and having a right incline and a left incline, the left incline having a first through hole in communication with the first electrode, the right incline having a second through hole in communication with the second electrode, the left incline and the right incline on two sides of the fulcrum, the fulcrum located at a highest position of a connection adjoining the right incline and the left incline;

a safety shutter capable of sliding on the support platform and swinging with respect to the fulcrum, when in a first position the safety shutter locating at the fulcrum with equilibrium and masking the first electrode and the second electrode, the safety shutter including a first incline and a second incline, a first side of the second incline having a first punch-through hole, the plug pins being in connection with the first incline and the second incline, and the first incline and the second incline pushing the safety shutter away from the first position to a second position;

a top cover having one side in proximity of a second side of the first incline and the second incline and a first receptacle corresponding to the first electrode and a second receptacle corresponding to the second electrode, and the top cover overlaying the base with the safety shutter between the top cover and the base; and an elastic member, one end of the elastic member in contact with the safety shutter, for maintaining the safety shutter at its first position using the elasticity thereof.

2. The power outlet according to claim 1, wherein when in the first position either the first incline or the second incline of the safety shutter is positioned to be contacted by at least one of the plug pins of the power plug.

3. The power outlet according to claim 1, wherein when in the first position the first incline of the safety shutter is positioned to be contacted by at least one of plug pins, which causes the first incline to push the safety shutter to the second position while enabling the second incline to be contacted by another plug pin.

4. The power outlet according to claim 1, wherein a center of the first incline is formed with a cavity corresponding to at least one of the plug pins of the safety shutter.

5. The power outlet according to claim 1, wherein an inner surface of the top cover is formed with a third incline corresponding to the right incline of the safety shutter and a recess corresponding to the left incline of the safety shutter, the third incline and the right incline tilting symmetrically with respect to a direction along which the safety shutter slides, the safety shutter equipped with a protruding block in the proximity of the first incline, and the protruding block sliding within the groove, which restrains the protruding block when the safety shutter is pushed to the second position.

* * * * *